US008367019B2

(12) United States Patent
Santha et al.

(10) Patent No.: US 8,367,019 B2
(45) Date of Patent: Feb. 5, 2013

(54) METHOD FOR THE PREPARATION OF A MICROFLUIDIC CHANNEL

(75) Inventors: Hunor Santha, Vac (HU); Gabor Harsanyi, Budapest (HU); Norbert Geza Stuban, Alsoors (HU)

(73) Assignee: Budapesti Muszaki es Gazdasagtudomanyi Egyetem, Budapest (HU)

( * ) Notice: Subject to any disclaimer, the term of this patent is extended or adjusted under 35 U.S.C. 154(b) by 254 days.

(21) Appl. No.: 12/682,288

(22) PCT Filed: Oct. 10, 2008

(86) PCT No.: PCT/HU2008/000117
§ 371 (c)(1),
(2), (4) Date: Apr. 9, 2010

(87) PCT Pub. No.: WO2009/047573
PCT Pub. Date: Apr. 16, 2009

(65) Prior Publication Data

US 2011/0008211 A1 Jan. 13, 2011

(30) Foreign Application Priority Data

Oct. 12, 2007 (HU) ..... 0700670

(51) Int. Cl.
*B01L 3/00* (2006.01)

(52) U.S. Cl. ..... 422/502

(58) Field of Classification Search ..... 422/502
See application file for complete search history.

(56) References Cited

U.S. PATENT DOCUMENTS

| | | | |
|---|---|---|---|
| 5,575,872 | A | 11/1996 | Tsukada et al. |
| 6,599,436 | B1 | 7/2003 | Matzke et al. |
| 2003/0156992 | A1 | 8/2003 | Anderson et al. |

(Continued)

FOREIGN PATENT DOCUMENTS

| | | | |
|---|---|---|---|
| EP | 1 561 723 | A1 | 8/2005 |
| EP | 1 614 467 | A2 | 1/2006 |
| EP | 1614467 | A2 * | 1/2006 |
| WO | WO 2004/063103 | A1 | 7/2004 |

OTHER PUBLICATIONS

International Search Report for PCT/HU2008/000117. Jan. 2008. 6 pages.*

(Continued)

*Primary Examiner* — Bobby Ramdhanie
(74) *Attorney, Agent, or Firm* — Millen, White, Zelano & Branigan, P.C.

(57) ABSTRACT

The invention relates to a microfluidic channel (6) with shifted levels comprising a channel pillar (2*a*, 2*b*) and a channel bridge (3) which microfluidic channel (6) connects a channel (4*a*, 4*b*), situated in a first level of a base plate (1, 11) which contains a microfluidic system, with a second level of said base plate (1, 11). A longitudinal hollow with an edgeless cross-section is connected, as a channel pillar (2*a*, 2*b*), with one end, to the ending of the channel (4*a*, 4*b*) to be connected and formed in the first level of the base plate (1, 11), furthermore, the channel bridge (3) created at the second level of the base plate (1, 11) and having a cross-section fitting to the channel pillar (2*a*, 2*b*) is surrounded by a filling-up material (7) filled in subsequently, and a rounding-off is formed at the junction of the connecting end of the channel bridge (3) and the end of the channel pillar (2*a*, 2*b*) extending to the second level.

13 Claims, 3 Drawing Sheets

U.S. PATENT DOCUMENTS

Figure 1:
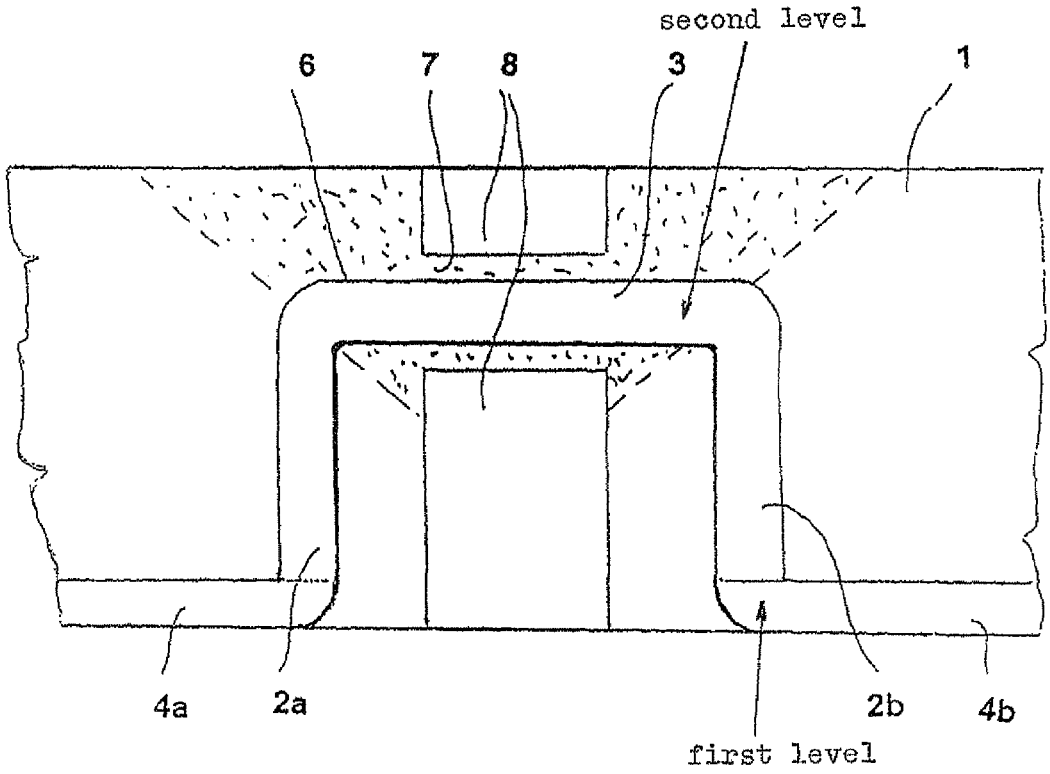

| | | | |
|---|---|---|---|
| 2004/0129371 | A1 | 7/2004 | Natarajan et al. |
| 2004/0226620 | A1 | 11/2004 | Therriault et al. |
| 2006/0001039 | A1 | 1/2006 | Zamanian |
| 2006/0153741 | A1 | 7/2006 | Yoshida |
| 2007/0012891 | A1 | 1/2007 | Maltezos et al. |

OTHER PUBLICATIONS

International Search Report of PCT/HU2008/000117 (Jan. 16, 2009).

* cited by examiner

METHOD FOR THE PREPARATION OF A MICROFLUIDIC CHANNEL

The invention relates to a microfluidic channel with shifted levels which connects a channel, situated in a first level of a base plate containing a microfluidic system, to a second level of said base plate, and said microfluidic channel comprises a channel pillar and a channel bridge. In addition, the invention is a method for the implementation of said microfluidic channel with shifted levels. Furthermore, our invention is a microfluidic system containing said microfluidic channel with shifted levels, which contains a base plate, reagent containers, sample inlet and air outlet openings formed in said base plate, a connection channel network formed on the first level of said base plate, at the surface of it, channel(s) with shifted levels connecting the first level to a second level, situated in the interior of said base plate and a cover plate which seals the base plate at its surface plane neighbouring the first level of the base plate where the quantity of the elements formed in the base plate, their location and their connection with each other is realized at any time according to the specific purpose.

Microfluidic devices are applied in the fields of biotechnology, chemical analysis and hi-tech clinical chemistry. A microfluidic system is, in fact, the miniaturisation of a regular analytical laboratory equipment implementing some analytical method or an analytical procedure, which is suitable for dosing certain reagents and/or buffers in a determined order into miniature reaction spaces, and enables the readout of results of the performed assay. Microfluidic systems are most commonly applied in near-patient rapid biomedical assays or, in more complex cases, in so-called micro Total Analysis Systems. A microfluidic system is, in general, a system of pipes and hollows established on some type of plastic, glass or silicon substrate as its base plate. The complexity of a system to be established would be limited if the system of pipes and hollows could be built up only in one certain level of the base plate. For example, in order to establish a more complex system of pipes and hollows, or, to establish valves for ensuring that certain pipe sections can be closed and opened separately, a shift of levels between certain channels is necessary, i.e. bridgings of channels have to be formed in the interior of the base plate, that is, channels with shifted levels are needed. Forming of such structures raises serious technological problem which is most often solved by the forming of structures piled upon each-other, so-called sandwich-structures. Such a solution is introduced e.g. in the specification of the patent application US2005130292. Furthermore, there are solutions in which the sandwich-structure is combined with lithographic technique. It is typical of such solutions that they require complex equipments, thus, they and their implementation are complicated and costly. In addition, sandwich-structures also imply the risk that at the junctions of different layers the channel walls are not smooth and rounded, and from fluid dynamics point of view this fact may lead to the generation of turbulences and dead volumes resulting in the inaccuracy of the assay as well as the measurement.

The aim of our invention is to provide a microfluidic channel with shifted levels and a microfluidic system with which the deficiencies of the state of the art can be eliminated without requiring a special manufacturing equipment, and a channel with shifted levels can be established more simply and cheaply than known solutions, i.e. it is suitable to perform clinical rapid assays in a cost-effective way, while at the same time an approximately turbulence-free and dead-volume-free flow can be ensured in the bridging channels having shifted levels, which property improves the accuracy of the assays.

According to the invention, we can achieve the set goal by forming the channel(s) starting from a monolithic substrate base plate, instead of applying sandwich-structures built up by elaborating several layers following each-other. This can be solved by forming the pillar-like portion(s) of the channel with shifted levels by creating a hollow with an edgeless cross-section in the base plate, by, e.g. drilling, while, the channel portion constituting the bridge-like part connecting to the channel pillar(s) is created by hollowing out the base plate spatially to the necessary extent at the channel pillar(s), in a way also sectioning the channel pillar(s), and fitting a round-ended patterning profile-piece of a removable material onto the channel pillar(s) as a bridge, then filling the hollowed part of the base plate around the patterning profile-piece with a filling-up material which is hardened afterwards, and then removing the patterning profile-piece from it with a chemical or a physical method. It is easy to place also a valve function to the channel bridge formed in such way.

The present invention, as described also in the attached claims, is accordingly, a microfluidic channel with shifted levels which connects a channel, situated in a first level of a base plate which contains a microfluidic system, to a second level of said base plate, and comprising a channel pillar and a channel bridge, where a longitudinal hollow with an edgeless cross-section, expediently a cylindrical borehole, is connected, as a channel pillar, with one end to the ending of the channel to be connected and formed in the first level of the base plate and the axis of said longitudinal hollow extends advantageously in a perpendicular direction from the surface plane of the base plate towards the second level, furthermore, the channel bridge created at the second level of the base plate and having a cross-section fitting to the channel pillar is surrounded by a filling-up material filled in subsequently, and a rounding-off is formed at the junction of the connecting end of the channel bridge and the end of the channel pillar extending to the second level.

The first level is expediently built up at the surface plane of the base plate sealed with a cover plate.

The first and the second levels are expediently parallel with each other.

In case the filling-up material surrounding the channel bridge is resilient and if there is a material-free, hollow space around the resilient material portion surrounding the channel bridge or at least at two sides beside it, then it is possible to form a valve-structure at the channel bridge which is capable to open or close the channel.

In addition, the invention is a method for the implementation of a microfluidic channel with shifted levels, which channel with shifted levels connects a channel, situated in a first level of a base plate containing a microfluidic system, to a second level of said base plate by emerging from the first level of the base plate, where said microfluidic channel is expediently built up at the surface plane of the base plate sealed with a cover plate, which channel with shifted levels comprises channel pillar(s) and a channel bridge, where a longitudinal edgeless hollow, expediently a cylindrical borehole is created as a channel pillar which emerges from the first level of the base plate, suitably from the plane of its main channel network, and the axis of the hollow is expediently at right angles to the base plate, then, in order to form a channel bridge, a hollow is created in the base plate at the end of the channel pillar extending to the second level of the base plate, by slicing off, expediently obliquely, and a patterning profile-piece, expediently a rod which is of a removable material and round-ended and having a cross-section fitting into the orifice created at the section of the channel pillar, is inserted into the orifice of the channel pillar sliced off. Following this, the base plate portion that remained material free in place of the hollow is filled up in the surroundings of the patterning profile-piece and the channel pillar with a filling-up material appropriate for fitting to the base-plate. Afterwards, the treatment necessary for the solidification of the filling-up material is performed, and then the patterning profile-piece is removed with a chemical or a physical process.

The channel bridge is expediently created on a second level parallel with the first level of the base plate.

It is advantageous if the base plate is sliced along such a section plane which is perpendicular to a plane defined by the longitudinal axis of the channel pillar and the longitudinal axis of the channel bridge to be created, where the smallest angle between the section plane and the longitudinal axis of the channel pillar as well as between the plane of the first level of the base plate is practically 45°.

From the aspect of manufacturing technology it may be advantageous to approximate the mentioned section plane with superficies of a cone, i.e., to carry out the slicing of the base plate along a surface of a cone.

It may be expedient if the slicing of the channel pillar and the creation of the hollow are not performed subsequently but rather at the same time with the creation of the channel network of the base plate.

In order to ensure a possibility of developing a valve function it is advantageous if a material-free part is formed at a portion of the filling-up material surrounding the patterning profile-piece, expediently a rod, constituting the channel bridge, around or at least on two sides beside it.

It is advantageous to fill up the base plate with a liquid polymer, as a filling-up material suited to the base plate, which later on, e.g. when cooled down or cured by other means, solidifies and hardens.

The patterning profile-piece is removed, depending on the nature of its own material and the filling-up material, as well as the material of the base plate by chemical etching or by melting.

Furthermore, our invention is a microfluidic system containing a base plate in which reagent containers, sample introduction and air outlet openings are formed, further containing a connection channel network formed in the base plate, on its first level, at its surface plane, a microfluidic channel or channels with shifted levels linking the first level to the second level, situated in the interior of the base plate, and further containing a cover plate sealing the base plate on its surface plane where the quantity of the elements formed in the base plate, their location and their connection with each other are realized at any time according to the specific purpose, and where the microfluidic channel with shifted levels is developed in a way in which a longitudinal hollow with an edgeless cross-section, expediently a cylindrical borehole, is connected, as a channel pillar, with its one end to the ending of the channel to be connected and situated on the first level of the base plate, and the axis of said longitudinal hollow extends in a perpendicular direction from the surface plane of the base plate towards the second level, further on, where the channel bridge created at the second level of the base plate and having a cross-section fitting to the channel pillar is surrounded by a filling-up material filled in subsequently, and a rounding-off is formed at the junction of the connecting end of the channel bridge and the end of the channel pillar extending to the second level.

To ensure a possibility of developing a valve it is advantageous if the filling-up material surrounding the channel bridge is resilient allowing the valve structure to be formed at the channel bridge.

In another preferred embodiment, a material-free, hollow part is formed around a portion of the resilient, filling-up material surrounding the channel bridge or at least at the two opposite sides of the cross-sections of the channel bridges, by the help of which the portion of the resilient filling-up material surrounding the channel bridge can be squeezed together with a proper tool.

In case the base plate is of a resilient material at least at the necessary places of access, i.e. in its surface plane opposite to the cover plate, at least above the reagent containers, then microfluidic systems can be created in which the reagents can be moved in the channel system manually by applying pressure of a fingertip.

By means of the microfluidic channel with shifted levels according to the invention, and of the method for its implementation, and of the microfluidic system containing said channel, microfluidic systems capable to perform clinical rapid assays can be produced relatively simply and cost-effectively, while at the same time, the accuracy of the assay results is ensured by the fact that the possibility of the generation of turbulences and dead volumes is kept at the minimum.

BRIEF DESCRIPTION OF THE SEVERAL VIEWS OF THE DRAWING(S)

Our invention is presented in detail with preferred embodiments by means of drawings.

Figure 2:
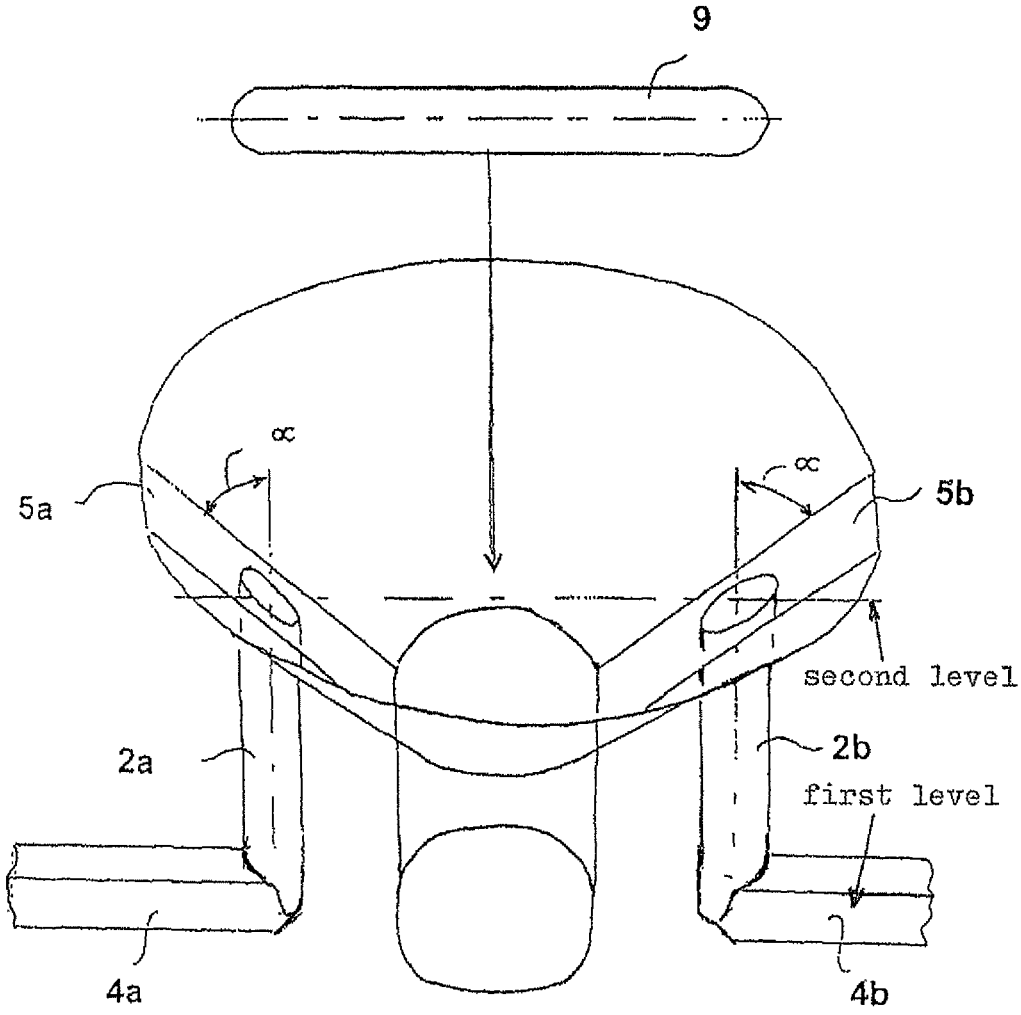

FIG. 1: An embodiment of the microfluidic channel with shifted levels according to the invention in a section plane perpendicular to the surface plane of the base plate FIG. 2: A stage of the preparation process of the microfluidic channel with shifted levels according to FIG. 1 is presented in a schematic axonometric view FIG. 3: A preferred embodiment of the microfluidic system according to the invention in a view from above In a base plate 1 with a thickness of 6 mm a microfluidic channel 6 with shifted levels according to FIG. 1 is formed, which connects channels 4*a* and 4*b* of the channel network created in the base plate 1 or, expressed more precisely, deepened from the surface plane of the base plate 1.

The material of base plate 1 is polycarbonate (PC) or polymethilmethacrilate (PMMA) or another material, e.g. a material of those mentioned in the introduction. The microfluidic channel 6 with shifted levels consists of channel pillars 2*a* and 2*b* and a channel bridge 3. Channel bridge 3 is roughly 4 mm high above the surface plane of the base plate 1. In our embodiment the channel pillars 2*a* and 2*b* are formed by means of cylindrical boreholes drilled perpendicularly into the surface plane of the base plate 1. However, so-called hot embossing technique may also be applied for the production or, the boreholes may also be produced by injection molding along with the manufacturing of the base plate. Channel bridge 3 which also has a circular cross section is created parallel with the surface plane of the base plate 1 between the ends of the boreholes extending into the interior of the base plate 1, by slicing off the base plate 1 at the channel pillars 2*a*, 2*b* in a way represented in FIG. 2, and by caving the base plate 1 between the ends of the boreholes on the sides where the slicing off took place, and by removing the base plate material sliced off and caved out. Following this, a rod 9 of a removable material and expediently of a cross-section which is essentially identical with that of the channel pillars 2*a*, 2*b* is inserted into the orifice of the channel pillars 2*a*, 2*b*, according to the arrow in FIG. 2. Then, the base plate 1 part that remained material-free in the place where the slicing off and caving took place, in the surroundings of the rod 9 and the boreholes is filled up with a liquid phase filling-up material 7 fitting to the base plate 1 also after hardening. After this, the necessary treatment is performed. In our case, we simply wait for 24 hours or provide a 1-hour heat treatment at 120° C. in order to harden the filling-up material, and then, remove the rod 9 with a chemical or a physical process.

The base plate 1 is sliced along section planes 5*a* and 5*b*, respectively, which are perpendicular to the plane defined by the longitudinal axises of the channel pillars 2*a*, 2*b* and the channel bridge 3, where the smallest angle $\alpha$ between the section planes 5*a* and 5*b* and the longitudinal axis of the channel pillars 2*a* and 2*b*, respectively, as well as between the section planes 5*a* and 5*b* and the surface plane of the base plate 1 is some 45°.

The geometry achievable by oblique slicing can be realised with, e.g., an end cutter having an adequate cutting-edge profile, or by 3 dimensional rapid prototyping printer, or by injection molding along with the manufacturing of the base plate. Approximating the above described oblique slicing, it is possible to slice and cave out the base plate also along a surface which is the superficies of a cone, by means of an end mill cutter having a cutting-edge profile according to the desired cone.

Slicing and the development of the hollows can be performed simultaneously with the creation of other elements of the microfluidic base plate, e.g. in the course of injection molding, without any removal of materials. The inserted rod 9, with a length of 5 mm and a diameter of 0.6 mm can be made of chemically etchable metal or plastic, and its ends are rounded with a fillet of 0.3 mm radius. In order to ensure good joining the diameter of rod 9 can be selected to be of slightly bigger compared to the diameter of channel pillars 2*a* and 2*b*, therefore, this is also implied in the wording of "cross-section which is essentially identical". Also for the improved joining, the material of rod 9 and the material of base plate 1 can also be selected to be different in hardness from each other.

The filling-up material is polydimethylsiloxane (PDMS) or another substance melting below the melting temperature of the base plate 1, with which the base plate 1 is filled up and which after it has cooled down, solidifies and hardens. However, other materials that do not harden under the impact of heat but of changes in another parameter like, e.g. the passing of time, may also come in question.

A material-free part 8 is formed around a portion of the filling-up material 7 surrounding the channel bridge 3. This can be achieved, e.g. by inserting two patterns before filling up with the filling-up material and opposed to each other and, each pattern shaped like a triumphal arch, which are removable after the filling up, so the resilient filling-up material 7 surrounding the channel bridge 3 formed at the place of the rod 9 will be surrounded by a material-free space. The material-free part 8 can also be shaped in another form, e.g. two hollow parts formed in the filling-up material 7 just on two sides beside the channel bridge 3 can enable the channel bridge 3 to be squeezed.

The rod 9 can be removed, depending on the materials selected, through chemical etching or by melting.

As a matter of course, the cross section of the channel pillars 2*a*, 2*b* and that of the rod 9 with a rounded end can have some other edgeless cross-section than a circle, e.g. an ellipse or some other oval formation, too, and the channel pillars 2*a*, 2*b* are not by all means perpendicular to the surface planes of the base plate 1.

The precise and smooth joining between the channel pillar and channel bridge can be adjusted by means of the cross-section form and the size tolerances of the channel pillar and the patterning rod, further by means of the hardness as well as resilience of the base plate and of the patterning rod, as well as, by the shape of the rounding-off of the rod ends.

Figure 3:
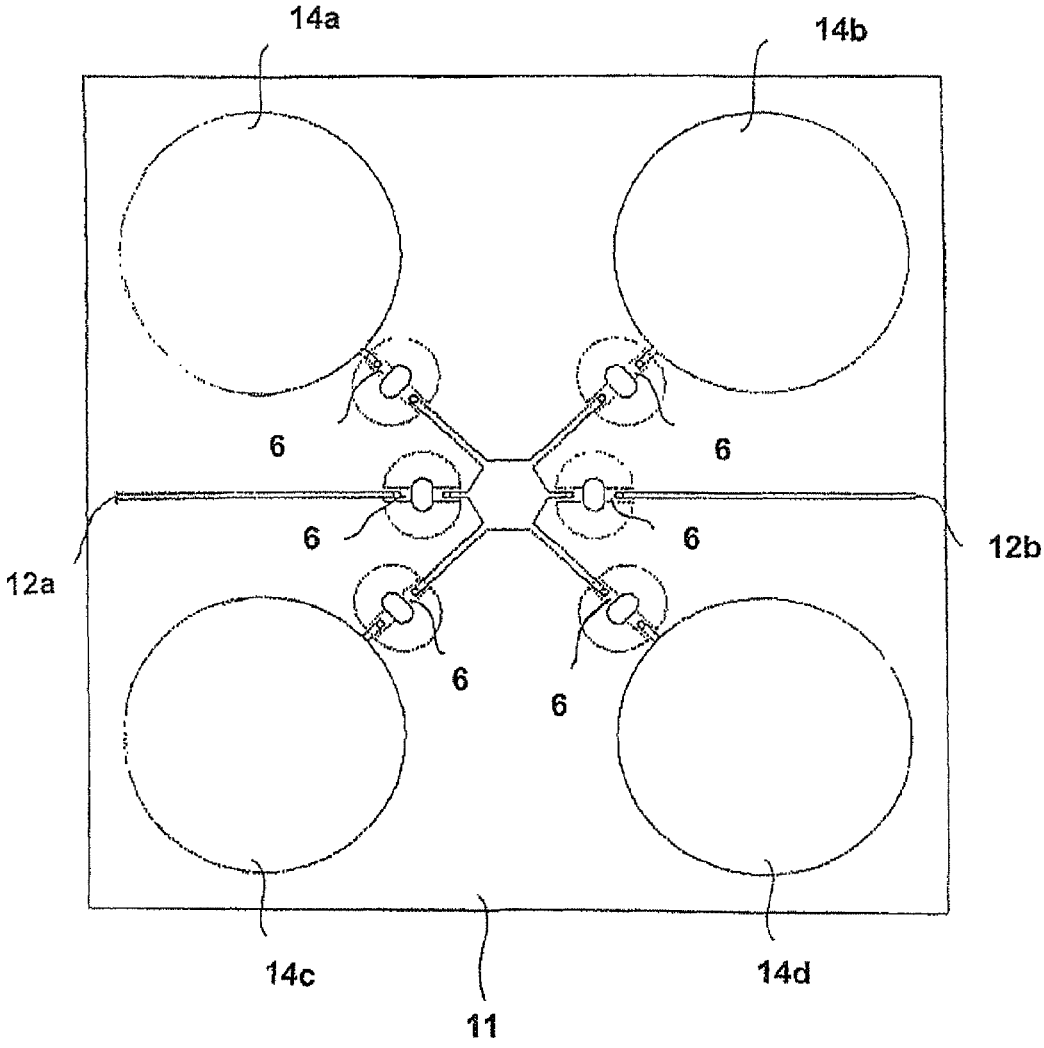

In FIG. 3 a microfluidic system is shown which, in our case, contains the reagent containers 14*a*, 14*b*, 14*c*, 14*d* recessed in the surface plane of the base plate 11 as well as sample inlet and air outlet openings 12*a* and 12*b*, the connection channel network without any separate reference number indication but well visible, the microfluidic channels 6 with shifted levels that link the connection channels situated at the surface plane of the base plate 11 and extend from the surface plane of the base plate 11 towards the interior of the base plate 11. In addition, it contains a cover plate, not shown in the Figure, which seals the base plate 11 at its surface plane and ensures that the fluids cannot leak from the system. Naturally, countless microfluidic systems are conceivable depending on tasks and solution modes, different from the present example. Therefore, the quantity of the elements formed in the base plate, their location and their connection with each other are realized at any time according to the specific purpose. The base plate 11 is of a resilient material at the reagent containers at its upper surface plane, i.e. at the surface plane on the side opposite to the cover plate. The sample inlet and air outlet openings 12*a*, 12*b* are boreholes passing through the base plate 11. The channel network is created at the surface plane of the base plate 11 covered by a coverplate, by means of, e.g. pressing, hot embossing or injection molding or by other technology. The bridging microfluidic channels 6 with shifted levels are formed as described in connection with FIGS. 1 and 2. A valve is placed around the resilient filling-up material 7 surrounding the channel bridges 3, in such a way that a material-free part 8 is created around the filling-up material 7 surrounding the channel bridge 3, thus, the resilient material portion surrounding the channel bridge 3 can be squeezed together with a proper tool. By means of the valves the channels as well as reagent containers can be opened and closed.

The invention presented here may be realised in many embodiments different from those described in the examples above but still remaining within the scope and spirit of the present invention, therefore, our invention cannot be regarded as limited to the examples.

The invention claimed is:

1. A method for preparing a microfluidic channel (6) with shifted levels, wherein said microfluidic channel (6) with shifted levels connects a channel (4*a*, 4*b*), situated in a first level of a base plate (1, 11) containing a microfluidic system, with a second level of said base plate (1, 11), by emerging from the first level of the base plate (1,11), wherein said microfluidic channel (6) with shifted levels comprises channel pillar(s) (2*a*, 2*b*) and a channel bridge (3), comprising:

creating a longitudinal edgeless hollow, as a channel pillar (2*a*, 2*b*) which emerges from the first level of the base plate (1, 11), then, in order to form a channel bridge, a hollow area created in the base plate (1, 11) at the end of channel pillar (2*a*, 2*b*) and slicing off the portion of the base plate (1, 11) at the end of channel pillar (2*a*, 2*b*) thereby creating a material-free hollow area extending to the second level of the base plate (1, 11), and inserting a patterning profile-piece which is made of a removable material and has a cross-section that fits into an orifice created at the section of the channel pillar (2*a*, 2*b*) where the channel pillar has been sliced off, then filling-up the base plate (1, 11) part that remained material-free in place of the hollow area surrounding of the patterning profile-piece and the channel pillar (2*a*, 2*b*) with a filling-up material (7) to fit to the base-plate (1, 11), and then, solidifying the filling-up material (7) and then removing the patterning profile-piece with a chemical or a physical process.

2. A method according to claim 1, wherein the channel bridge (3) is formed on a second level parallel with the first level of the base plate (1, 11).

3. A method according to claim 1, wherein the base plate (1, 11) is sliced along a section plane (5*a*, 5*b*) which is perpendicular to a plane defined by the longitudinal axis of the channel pillar (2*a*, 2*b*) and the longitudinal axis of the channel bridge (3) to be created, where the smallest angle ($\alpha$) between the section plane (5*a*, 5*b*) and the longitudinal axis of the channel pillar (2*a*, 2*b*) as well as between the plane of the first level of the base plate is practically 45°.

4. A method according to claim 1, wherein the base plate (1, 11) is sliced along a surface of a cone.

5. A method according to claim 1, wherein the slicing of the channel pillar (2*a*, 2*b*) and the creating of the hollow are performed at the same time as the creating of the channel network of the base plate (1, 11).

6. A method according to claim 1, wherein in order to ensure a possibility of developing a valve function a material-free part (8) is formed in the filling-up material (7) in a portion surrounding the patterning profile-piece, constituting the channel bridge (3), around or at least on two sides beside the profile-piece.

7. A method according to claim 1, wherein the base plate (1, 11) is filled up with a liquid polymer, as a filling-up material (7), which further on, when cooled down or cured, solidifies and hardens.

8. A method according to claim 1, wherein the patterning profile-piece is removed by chemical etching or by melting.

9. A method according to claim 1, wherein the longitudinal edgeless hollow is formed as a cylindrical borehole.

10. A method according to claim 1, wherein the patterning profile-piece is a rod (9).

11. A method according to claim 1, wherein the patterning profile-piece has been provided with rounded ends.

12. A method according to claim 1, wherein the longitudinal edgeless hollow has its axis at a right angle to the base plate (1, 11).

13. A method according to claim 1, wherein the portion of the base plate (1, 11) at the end of channel pillar (2*a*, 2*b*) extending to the second level of the base plate (1, 11) is sliced off obliquely.

* * * * *